US008763998B1

(12) United States Patent
Worstell

(10) Patent No.: US 8,763,998 B1
(45) Date of Patent: Jul. 1, 2014

(54) PORTABLE HAND HELD MITER CLAMP DEVICE

(76) Inventor: Jacob Worstell, Staten Island, NY (US)

( * ) Notice: Subject to any disclaimer, the term of this patent is extended or adjusted under 35 U.S.C. 154(b) by 402 days.

(21) Appl. No.: 13/170,685

(22) Filed: Jun. 28, 2011

(51) Int. Cl.
*B25B 1/00* (2006.01)

(52) U.S. Cl.
USPC ..... 269/6

(58) Field of Classification Search
USPC ..... 269/3, 6, 95, 166–171.5, 143, 249
See application file for complete search history.

(56) References Cited

U.S. PATENT DOCUMENTS 2,941,557 A 6/1960 Baprawski
3,682,467 A 8/1972 Heinrich
4,468,018 A * 8/1984 Vaizey ..... 269/54.5
4,673,174 A 6/1987 Tabbert
2003/0080485 A1* 5/2003 Lo ..... 269/6
2007/0176342 A1 8/2007 Noniewicz
2009/0224451 A1* 9/2009 Fuller et al. ..... 269/6

* cited by examiner

*Primary Examiner* — Lee D Wilson
*Assistant Examiner* — Nirvana Deonauth
(74) *Attorney, Agent, or Firm* — Crossley Patent Law; Micah C. Gunn

(57) ABSTRACT

The portable hand held miter clamp device provides several advantages. First, the device is portable and is used on site, rather than requiring that a work piece be transported to a clamp. Second, the device is extremely time efficient. A worker need only position the miter joint of the work piece, position the stationary drive lever as desired, and slide the clamping lever adjacent to the miter joint. The worker then triggers the device to clamp the joint. The quick release releases the device as desired, instantly. The device offers further advantage in that the spikes ensure no slippage of work piece engagement.

3 Claims, 2 Drawing Sheets

PORTABLE HAND HELD MITER CLAMP DEVICE

BACKGROUND OF THE INVENTION

Miter clamps have been used for ages and are presented in a myriad of shapes and forms. Some require that a work piece be transported to the clamp, while other are portable for on-the-job use. A long held problem with miter clamps, though, is actually convincing the clamp to grasp the work piece, as typically that piece is a right angle, and successfully removably adhering to each side can be quite difficult. The present device provides a portable hand held means for quickly and successfully closing a miter joint for final joining.

FIELD OF THE INVENTION

The portable hand held miter clamp device relates to miter clamps and more especially to portable miter clamps.

SUMMARY OF THE INVENTION

The general purpose of the portable hand held miter clamp device, described subsequently in greater detail, is to provide a portable hand held miter clamp device which has many novel features that result in an improved portable hand held miter clamp device which is not anticipated, rendered obvious, suggested, or even implied by prior art, either alone or in combination thereof.

To attain this, the portable hand held miter clamp device provides several advantages over some other types of miter clamps. First, the device is portable and is used on site, rather than requiring that a work piece be transported to a clamp. Second, the device is extremely time efficient. A worker need only position the miter joint of the work piece, position the drive lever as desired, and slide the clamp lever adjacent to the miter joint. The worker then triggers the device to clamp the joint. The quick release releases the device as desired, instantly. The device offers further advantage in that the spikes ensure no slippage, which has long been a problem with miter joint clamps that do not fully surround both sides of a joint. Spikes may be straight or upwardly slanted. Lever clamp faces may be flat. Lever recesses may be provided.

Thus has been broadly outlined the more important features of the improved portable hand held miter clamp device so that the detailed description thereof that follows may be better understood and in order that the present contribution to the art may be better appreciated.

An object of the portable hand held miter clamp device is to quickly and easily clamp a miter joint.

Another object of the portable hand held miter clamp device is to be highly portable.

A further object of the portable hand held miter clamp device is to be operable with only one hand, leaving the other hand free to progress in the work involved.

An added object of the portable hand held miter clamp device is to grasp a work piece without slippage.

And, an object of the portable hand held miter clamp device is to quickly release.

Another object of the portable hand held miter clamp device is to clamp a miter joint without having to totally surround the joint on all sides.

These together with additional objects, features and advantages of the improved portable hand held miter clamp device will be readily apparent to those of ordinary skill in the art upon reading the following detailed description of presently preferred, but nonetheless illustrative, embodiments of the improved portable hand held miter clamp device when taken in conjunction with the accompanying drawings.

DETAILED DESCRIPTION OF THE DRAWINGS

With reference now to the drawings, and in particular FIGS. 1 through 4 thereof, the principles and concepts of the portable hand held miter clamp device generally designated by the reference number 10 will be described.

Figure 4:
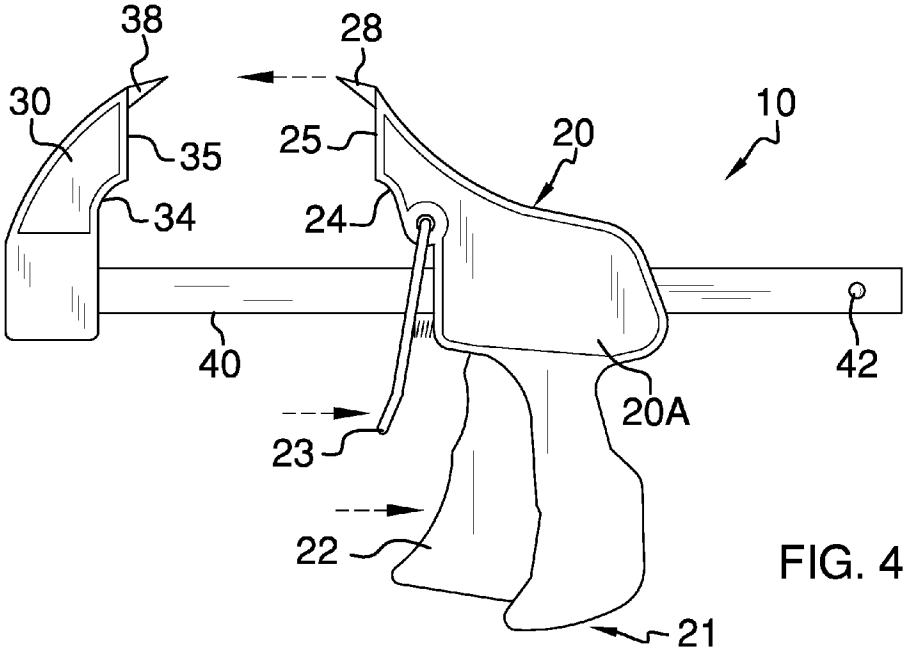
FIG. 4 is a lateral elevation view.
Figure 3:
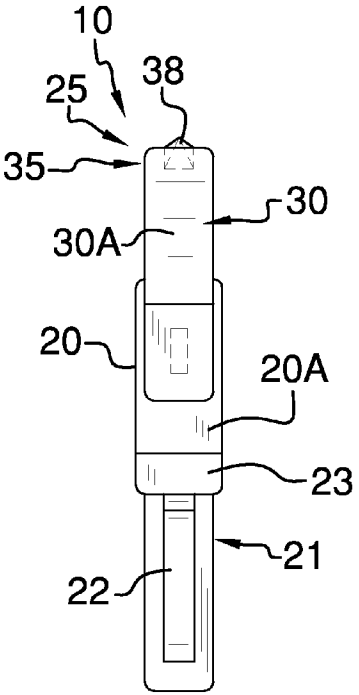
FIG. 3 is a front elevation view.

Referring to FIG. 4, the device 10 partially comprises the drive lever 20. The drive lever comprises a body 20A having a pistol grip 21 disposed downwardly from the body 20A. The trigger 22 is disposed forwardly on the pistol grip 21. The quick release 23 is disposed forwardly from the trigger 22. The quick release 23 allows sliding adjustment of the track bar 40 in large increments, where smaller incremental tightening of the levers is accomplished by the trigger 22. The recess 24 is disposed upwardly and medially on the body 20A. The flat clamp face 25 is disposed upwardly and medially from the recess 24. The spike 28 is extended angularly and medially upward from a top of the clamp face 25.

Figure 1:
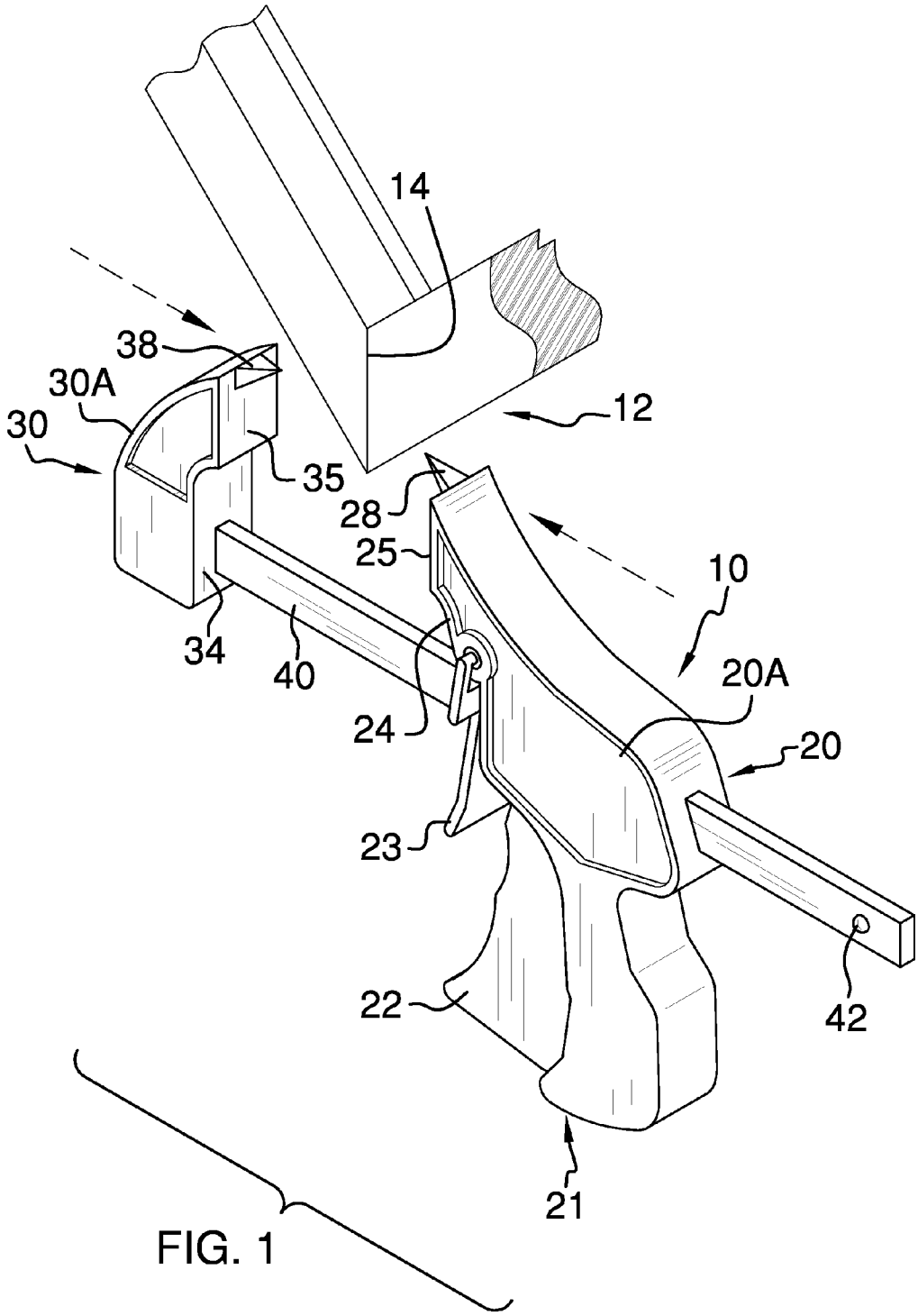
FIG. 1 is a perspective view.

Referring to FIG. 1, the spike 28 is in preparation of engaging the work piece 12 adjacent to the miter joint 14. The spike 28 ensures positive, non-slip work piece 12 engagement.

Referring again to FIGS. 1 and 4, the clamp lever 30 is connected to the drive lever 20 via the track bar 40 that is slideably engaged with the drive lever 20. The clamp lever 30 partially comprises the clamp lever body 30A. The clamp recess 34 is disposed upwardly and medially on the clamp lever body 30A. The flat lever clamp face 35 is disposed upwardly and medially from the clamp lever recess 34. The lever clamp face 35 is identical to and aligned with the drive lever 20 clamp face 25. The clamp spike 38 is extended angularly and medially upward from the top of the lever clamp face 35.

Figure 2:
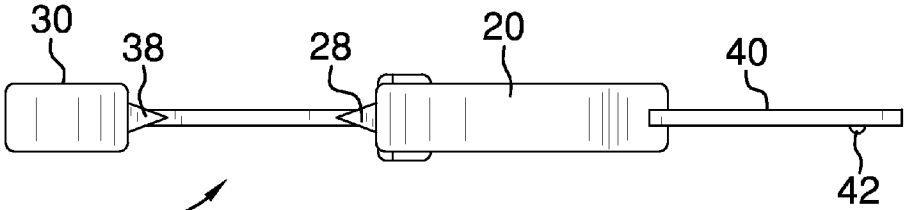
FIG. 2 is a top plan view.

Referring to FIG. 2, the stop 42 is disposed distally on the track bar 40. The stop 42 prevents passage of the distal end of the track bar 40 through and out of the drive lever 20.

Referring to FIG. 3 and again to FIG. 1, the clamp lever 30 and drive lever 20 clamp faces are disposed upwardly so that a work piece 12 is easily engaged.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the portable hand held miter clamp device may be used.

What is claimed is:

1. A portable hand held miter clamp device comprising, in combination: a drive lever comprising: a body; a pistol grip disposed downwardly from the body; a trigger disposed forwardly on the pistol grip; a quick release disposed forwardly from the trigger; a flat clamp face disposed upwardly and medially from the body; a spike extended angularly and medially from a top of the clamp face; the spike protruding above the top of the clamp face and a top surface of the body; a clamp lever connected to the drive lever via a track bar slideably engaged with the drive lever, the clamp lever comprising:

a clamp lever body; a lever clamp face disposed upwardly and medially from the clamp lever body, the lever clamp face identical to and aligned with the flat clamp face of the drive lever clamp face; a clamp spike extended medially from a top of the lever clamp face; a stop disposed distally on the track bar, the stop preventing passage of a distal end of the track bar through and out of the drive lever.

2. A portable hand held miter clamp device comprising, in combination: a trigger disposed forwardly on the pistol grip; a quick release disposed forwardly from the trigger; a flat clamp face disposed upwardly and medially from the body of the driver lever clamp lever body; a spike extended angularly and medially upward from a top of the clamp face; the spike protruding above the top of the clamp face and a top surface of the body; a clamp lever connected to the drive lever via a track bar slideably engaged with the drive lever, the clamp lever comprising: a clamp lever body; a lever clamp face disposed upwardly and medially from the clamp lever body, the lever clamp face identical to and aligned with the flat clamp face of the drive lever clamp face; a clamp spike extended angularly and medially upward from a top of the lever clamp face; a stop disposed distally on the track bar, the stop preventing passage of a distal end of the track bar through and out of the drive lever.

3. A portable hand held miter clamp device comprising, in combination: a drive lever comprising: a body; a pistol grip disposed downwardly from the body; a trigger disposed forwardly on the pistol grip; a quick release disposed forwardly from the trigger; a recess disposed upwardly and medially on the body; a flat clamp face disposed upwardly and medially from the recess; a spike extended angularly and medially upward from a top of the clamp face; the spike protruding above the top of the clamp face and a top surface of the body; a clamp lever connected to the drive lever via a track bar slideably engaged with the drive lever, the clamp lever comprising: a clamp lever body; a clamp recess disposed upwardly and medially on the clamp lever body a flat lever clamp face disposed upwardly and medially from the clamp recess of the clamp lever, the lever clamp face identical to and aligned with the flat clamp face of the drive lever clamp face; a clamp spike extended angularly and medially upward from a top of the lever clamp face; a stop disposed distally on the track bar, the stop preventing passage of a distal end of the track bar through and out of the drive lever.

* * * * *